US011578519B2

(12) United States Patent
Park et al.

(10) Patent No.: US 11,578,519 B2
(45) Date of Patent: Feb. 14, 2023

(54) REFRIGERATOR

(71) Applicant: Samsung Electronics Co., Ltd., Suwon-si (KR)

(72) Inventors: Taecheol Park, Suwon-si (KR); Byoungmok Kim, Suwon-si (KR); Jeonghyun Lee, Suwon-si (KR); Seokjun Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 150 days.

(21) Appl. No.: 17/161,208

(22) Filed: Jan. 28, 2021

(65) Prior Publication Data

US 2021/0238900 A1 Aug. 5, 2021

(30) Foreign Application Priority Data

Feb. 3, 2020 (KR) ..... 10-2020-0012366

(51) Int. Cl.
*E05D 7/00* (2006.01)
*E05D 3/02* (2006.01)
*F25D 23/02* (2006.01)

(52) U.S. Cl.
CPC ..... *E05D 7/0027* (2013.01); *E05D 3/02* (2013.01); *F25D 23/028* (2013.01); *E05Y 2900/31* (2013.01)

(58) Field of Classification Search
CPC ..... E05D 7/0027; E05D 3/02; E05D 5/14; E05D 7/081; F25D 23/028; F25D 2323/0011; F25D 2323/024; F25D 2400/18; E05Y 2900/31; E05Y 2600/10; E05Y 2600/51; E05Y 2600/61; E05Y 2600/624
See application file for complete search history.

(56) References Cited

U.S. PATENT DOCUMENTS 4,543,800 A * 10/1985 Mawby ..... F25D 23/028 439/31
5,941,619 A * 8/1999 Stieben ..... E05D 11/0081 312/405

(Continued)

FOREIGN PATENT DOCUMENTS

CN 107795215 B 7/2019
CN 112081480 A * 12/2020

(Continued)

OTHER PUBLICATIONS

PCT International Search Report & Written Opinion for International Application No. PCT/KR2021/000988 dated May 20, 2021.

*Primary Examiner* — Hanh V Tran
(74) *Attorney, Agent, or Firm* — Staas & Halsey LLP

(57) ABSTRACT

Disclosed is a refrigerator with a storage space. The refrigerator includes a main body including a storage space, a door configured to open and close the storage space, and a hinge provided under the door and configured to rotatably couple the door to the main body. The hinge includes a linear member accommodator configured to accommodate therein a linear member drawn out from the door, and a cut-out portion hollowed and configured to extend along a hinge axial direction to allow the linear member accommodator to communicate with an outside at one side.

11 Claims, 12 Drawing Sheets

(56) References Cited

U.S. PATENT DOCUMENTS

| | | | | |
|---|---|---|---|---|
| 8,567,885 | B2 * | 10/2013 | Lee | E05D 7/0027 312/405 |
| 9,593,518 | B2 * | 3/2017 | Downs | E05D 11/0081 |
| 2006/0143860 | A1 * | 7/2006 | Park | F25D 23/028 16/243 |
| 2007/0251261 | A1 * | 11/2007 | Son | F25D 27/00 62/390 |
| 2009/0038117 | A1 * | 2/2009 | Moon | F25D 23/028 16/240 |
| 2010/0147008 | A1 * | 6/2010 | Watson | F25D 23/126 62/340 |
| 2012/0124777 | A1 * | 5/2012 | Keller | E05D 5/14 16/381 |
| 2013/0047656 | A1 * | 2/2013 | Kang | F25D 23/028 62/389 |
| 2013/0154464 | A1 * | 6/2013 | Fiori | F25D 23/028 16/303 |
| 2014/0333191 | A1 * | 11/2014 | Sun | E05D 7/081 312/405 |
| 2017/0167173 | A1 * | 6/2017 | Johnson | E05D 5/128 |
| 2018/0149420 | A1 * | 5/2018 | Lee | H05K 5/0017 |
| 2019/0003224 | A1 * | 1/2019 | Reuter | F25D 23/028 |
| 2019/0024962 | A1 * | 1/2019 | Lee | F25D 23/025 |
| 2021/0247129 | A1 * | 8/2021 | Park | E05D 7/04 |

FOREIGN PATENT DOCUMENTS

| | | | | |
|---|---|---|---|---|
| EP | 2735680 | A2 * | 5/2014 | E05D 7/0027 |
| EP | 2735828 | A1 * | 5/2014 | F25D 23/028 |
| JP | 2000-39252 | | 2/2000 | |
| KR | 10-0735100 | | 7/2007 | |
| KR | 10-0839658 | | 6/2008 | |
| KR | 10-0896753 | B1 | 4/2009 | |
| KR | 10-0994808 | B1 | 11/2010 | |
| KR | 10-1070618 | | 10/2011 | |
| KR | 10-2014-0037662 | A | 3/2014 | |
| WO | WO-2007094523 | A1 * | 8/2007 | E05D 7/0027 |
| WO | WO-2021062498 | A1 * | 4/2021 | E05D 3/04 |

* cited by examiner

REFRIGERATOR

CROSS-REFERENCE TO RELATED THE APPLICATION

This application is based on and claims priority under 35 U.S.C. § 119 to Korean Patent Application No. 10-2020-0012366 filed on Feb. 3, 2020, in the Korean Intellectual Property Office, the disclosure of which is incorporated by reference herein in its entirety.

BACKGROUND

Field

The disclosure relates to a refrigerator, and more particularly to a hinge by which a door of a refrigerator is coupled to be openable or closable.

Description of the Related Art

A refrigerator includes a door to open and close a storage space of storing food, and a hinge to couple the door with a main body to be openable and closable. A floor on which the refrigerator will be installed may not be flat. In this case, the door might make noise or might not smoothly operate when opened and closed, due to distortion caused by height differences of the floor. To solve this problem, a height-adjustment ring having a thickness corresponding to the height difference may be inserted. However, such a method is cumbersome because height-adjustment rings of various thicknesses, or many height-adjustment rings, need to be prepared in advance, or the door of the refrigerator may need to be lifted up to insert a height-adjustment ring when the refrigerator is installed.

Moreover, the door of the refrigerator may be provided with a display and/or a light for displaying a state of the refrigerator or setting operations of the refrigerator. To supply electric power to the display and/or the light, there is a need of connecting an electric wire to the main body. However, because the door is frequently opened and closed and the storage space of the main body needs to be hermetically sealed, the electric wire may not be easily drawn out. In addition, when the electric wire is drawn out, exposure of the electrical wire to the outside may undesirably affect an outer appearance of the refrigerator.

SUMMARY

An aspect of the disclosure is to provide a refrigerator with a hinge by which height difference in a door is easily adjustable, and an electric wire and a like linear member are effectively drawn out from the door.

According to an embodiment of the disclosure, there is provided a refrigerator with a storage space. The refrigerator includes a main body including a storage space, a door configured to open and close the storage space, and a hinge provided under the door and configured to rotatably couple the door to the main body. The hinge includes a linear member accommodator configured to accommodate therein a linear member drawn out from the door, and a cut-out portion hollowed and configured to extend along a hinge axial direction to allow the linear member accommodator to communicate with an outside at one side.

The hinge may include a hinge pin, and a hinge cap configured to cover the hinge pin.

The cut-out portion may include a first cut-out portion formed in the hinge pin, and the hinge cap may include a second cut-out portion hollowed and configured to extend along the hinge axial direction to communicate with the first cut-out portion.

The hinge may include a height-adjustment member configured to move the hinge cap up and down.

The height-adjustment member may include the linear member accommodator, and the height-adjustment member may include a third cut-out portion hollowed and configured to extend along the hinge axial direction to allow the linear member accommodator to communicate with an outside at one side.

The hinge pin may include a through portion penetrated in the hinge axial direction, and a first threaded portion formed on an inner surface thereof, and the height-adjustment member may include a second threaded portion to be fastened to the first threaded portion of the through portion.

The hinge may include a hinge frame supported on the main body, and a hinge pin integrally formed in the hinge frame.

The hinge may include a hinge frame including a hinge-pin coupling hole penetrated in the hinge axial direction, a hinge pin fastened to the hinge-pin coupling hole.

The cut-out portion may include a first cut-out portion formed in the hinge pin, and the hinge frame may include a fourth cut-out portion hollowed and configured to extend along the hinge axial direction to allow the hinge-pin coupling hole to communicate with an outside.

The hinge may include a hinge frame supported on the main body, a nut supported on the hinge frame and a hinge pin screw-coupled to the nut.

The cut-out portion may include a first cut-out portion formed in the hinge pin, and the nut may include a fifth cut-out portion hollowed and configured to extend along the hinge axial direction to communicate with the first cut-out portion.

The linear member may be configured to be accommodated in the linear member accommodator through the first to third cut-out portions aligned with one another, and prevented from coming off by turning the height-adjustment member.

BRIEF DESCRIPTION OF THE DRAWINGS

The above and/or the aspects will become apparent and more readily appreciated from the following description of exemplary embodiments, taken in conjunction with the accompanying drawings, in which.

DETAILED DESCRIPTION OF EXEMPLARY EMBODIMENTS

Figure 1:
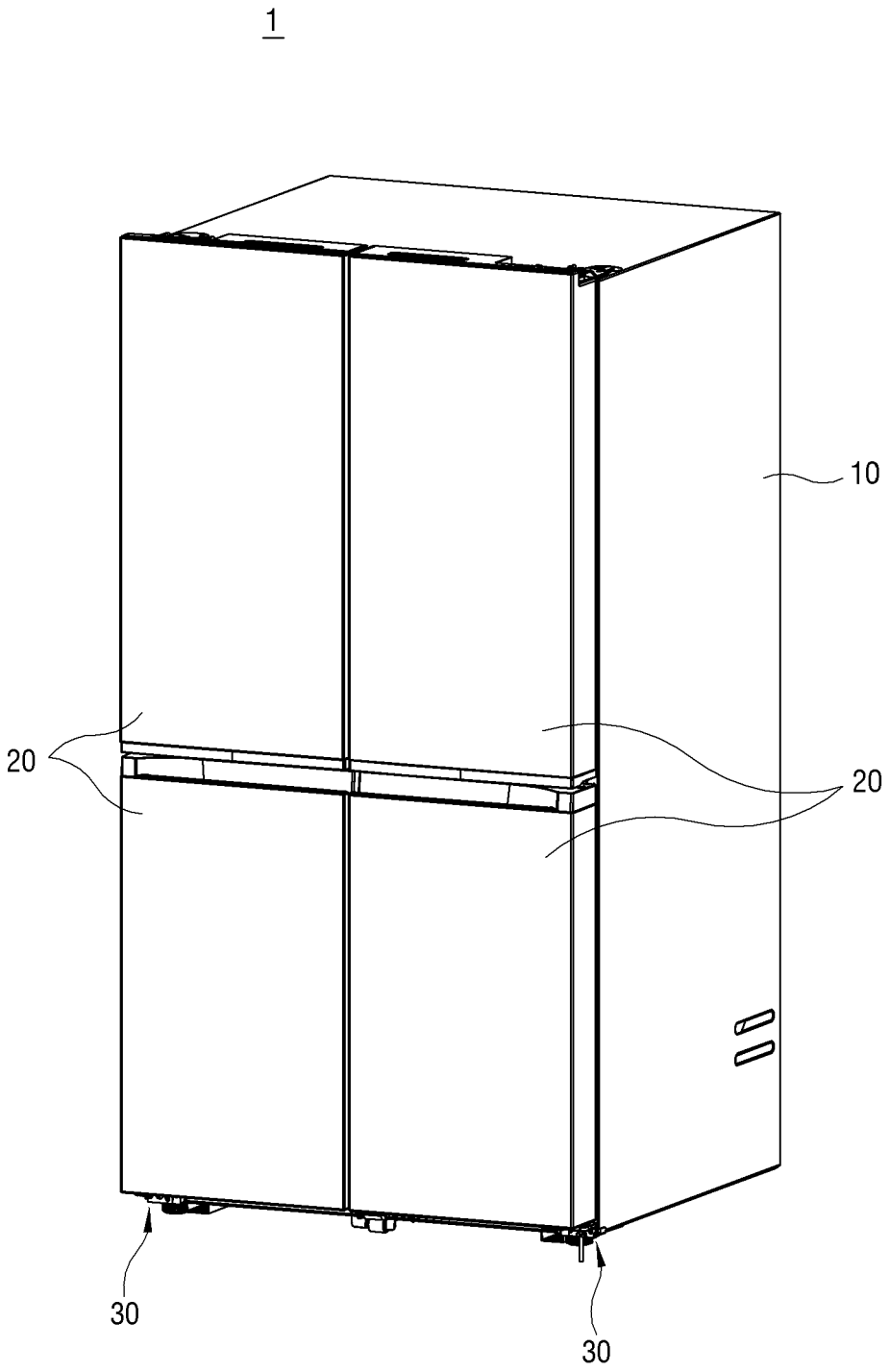
FIG. 1 is a perspective view of a refrigerator according to a first embodiment of the disclosure.

Below, embodiments of the disclosure will be described in detail with reference to the accompanying drawings. In the drawings, like numerals or symbols refer to like elements having substantially the same function, and the size of each element may be exaggerated for clarity and convenience of description. However, the technical concept of the disclosure and its key configurations and functions are not limited to those described in the following embodiments. In the following descriptions, details about publicly known technologies or configurations may be omitted if they unnecessarily obscure the gist of the disclosure.

In the disclosure, terms "have," "may have," "include," "may include," etc. indicate the presence of corresponding features (e.g. a numeral value, a function, an operation, or an element such as a part, etc.), and do not exclude the presence of additional features.

In the disclosure, terms "A or B", "at least one of A or/and B", "one or more of A or/and B" or the like may include all possible combinations of elements enumerated together. For example, "A or B", "at least one of A and B", or "at least one of A or B" may refer to all of the cases of (1) including at least one A, (2) including at least one B, or (3) including all of at least one A and at least one B.

In the disclosure, terms "first", "second", etc. are used only to distinguish one element from another, and singular forms are intended to include plural forms unless otherwise mentioned contextually.

In addition, in the disclosure, terms "upper", "lower", "left", "right", "inside", "outside", "inner", "outer", "front", "rear", etc. are defined with respect to the accompanying drawings, and do not restrict the shape or location of the elements.

Further, in the disclosure, the expression of "configured to (or set to)" may for example be replaced with "suitable for," "having the capacity to," "designed to," "adapted to," "made to," or "capable of" according to circumstances. Also, the expression of "configured to (or set to)" may not necessarily refer to only "specifically designed to" in terms of hardware. Instead, the "device configured to" may refer to "capable of" along with other devices or parts in a certain circumstance.

FIG. 1 is a perspective view of a refrigerator according to a first embodiment of the disclosure.

The refrigerator 1 according to an embodiment of the disclosure may for example be embodied by a general-type, double-door type, or three-door type refrigerator according to the number of doors and methods of opening the door.

Further, the refrigerator 1 according to the disclosure may for example be embodied by a 1-EVA, 2-EVA, or 3-EVA type refrigerator according to the number of evaporators for supplying cool air.

Further, the refrigerator 1 according to an embodiment of the disclosure may include a refrigerator having a refrigerator compartment and a freezer compartment where ice is made, a freezer having a freezer compartment for making ice, or an ice maker only for making ice.

Further, the refrigerator 1 according to an embodiment of the disclosure may include an indirect-cooling type or direct-cooling type standing refrigerator or a built-in premium freezer.

The refrigerator 1 according to an embodiment of the disclosure may be not limited by many various structures or uses, but embodied by all the kinds of refrigerators having the refrigerator compartment or the freezer compartment.

Referring to FIG. 1, the refrigerator 1 may include a main body 10 having a storage space, four doors 20 configured to open and close the storage space of the main body 10, and a hinge 30 configured to couple the door 20 with the main body 10 to be openable and closable.

The main body 10 may include four storage spaces corresponding to four doors 20, for example, a refrigerator compartment, a freezer compartment, an ice-making compartment, a Kimchi-storage compartment, etc.

The door 20 can hermetically close or open the storage space of the main body 10. The door 20 may be mounted with a display or a light. The display may display the state of the storage space, for example, current temperature, current humidity, etc. The display may include a touch input portion. The touch input portion is configured to allow a user to set desired temperature, humidity, etc. The display or light provided in the door 20 may receive electric power from the main body 10 through an electric wire. A control input set through the touch input portion may be transmitted to the main body 10 through a communication line, and a temperature or humidity value detected in the main body may be transmitted to the display through the communication line. Below, the electric wire and/or the communication line will be called a "linear member."

The hinge 30 makes the door 20 be coupled to the main body 10 and rotatably openable and closable with respect to the main body 10. The hinge 30 may be provided under the door 20 so that a height difference of the door 20 can be adjustable with respect to the main body 10. The hinge 30 having a function of adjusting the height difference may be applied to two lower doors 20 as shown in FIG. 1. Of course, the hinge 30 having the function of adjusting the height difference may be applied to all the four doors 20.

Figure 2:
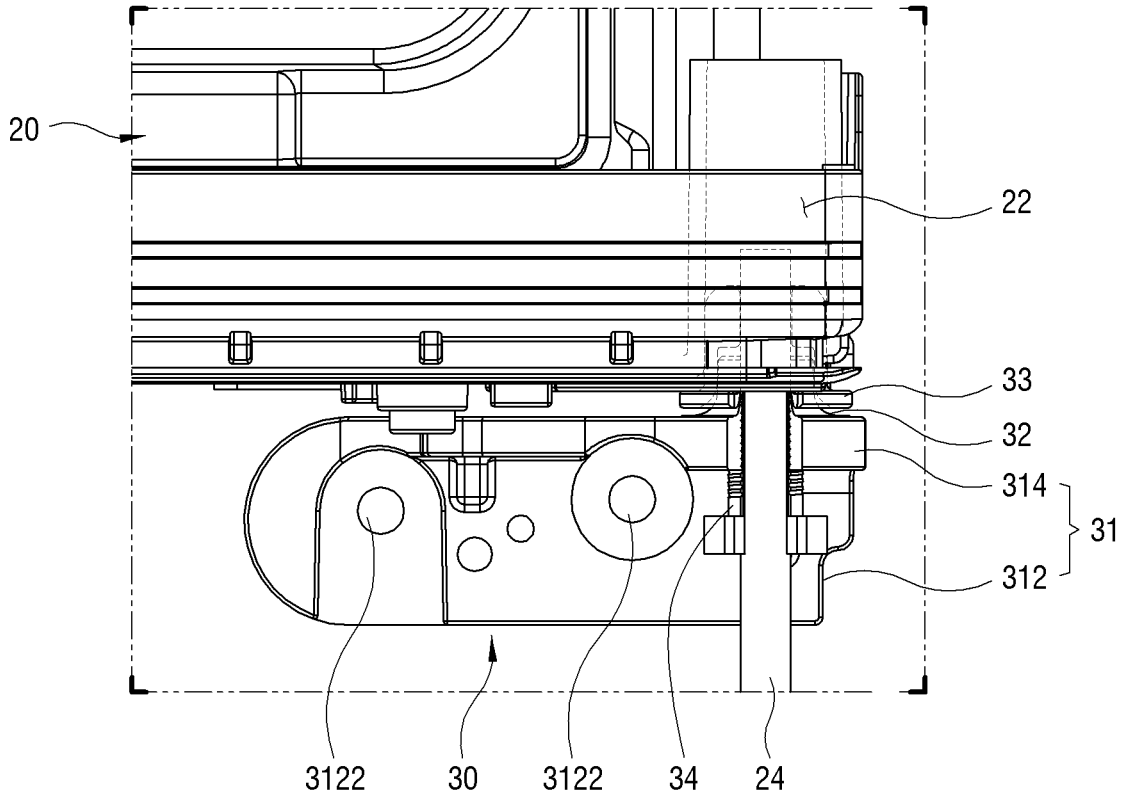
FIG. 2 is a front view showing that a hinge is applied to a door.
Figure 3:
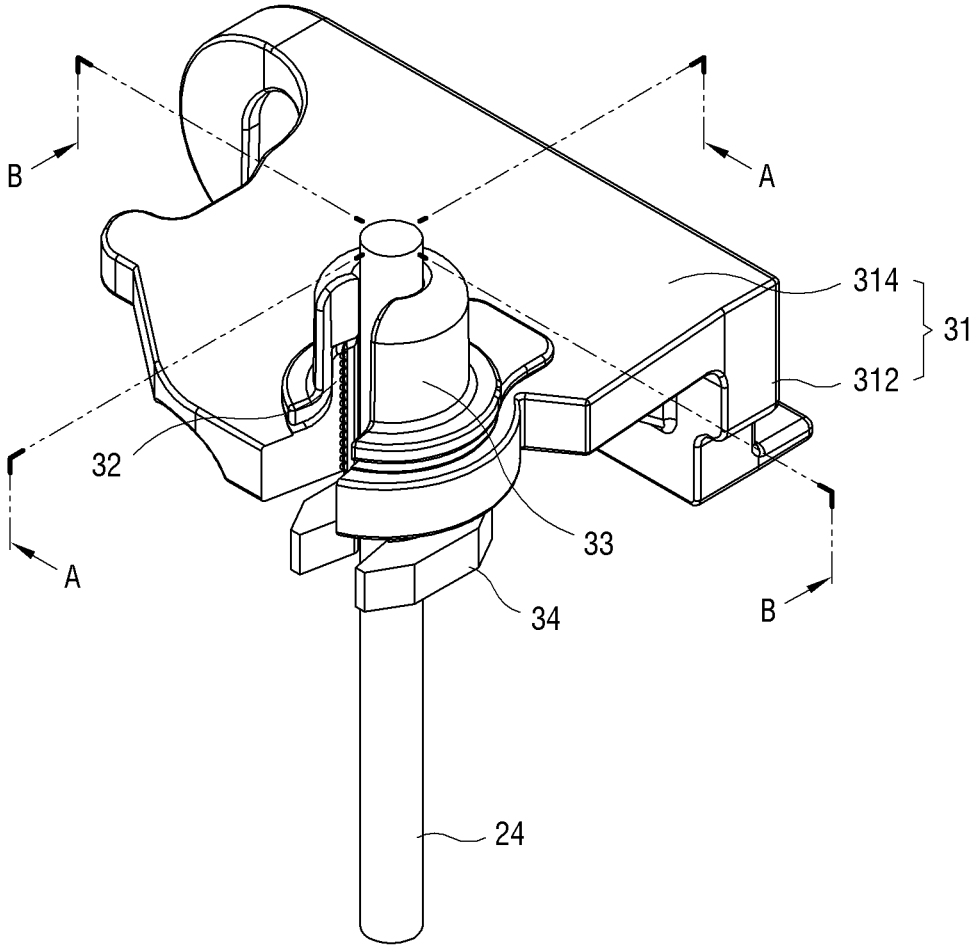
FIG. 3 is a perspective view of a hinge in the refrigerator according to the first embodiment of the disclosure.
Figure 4:
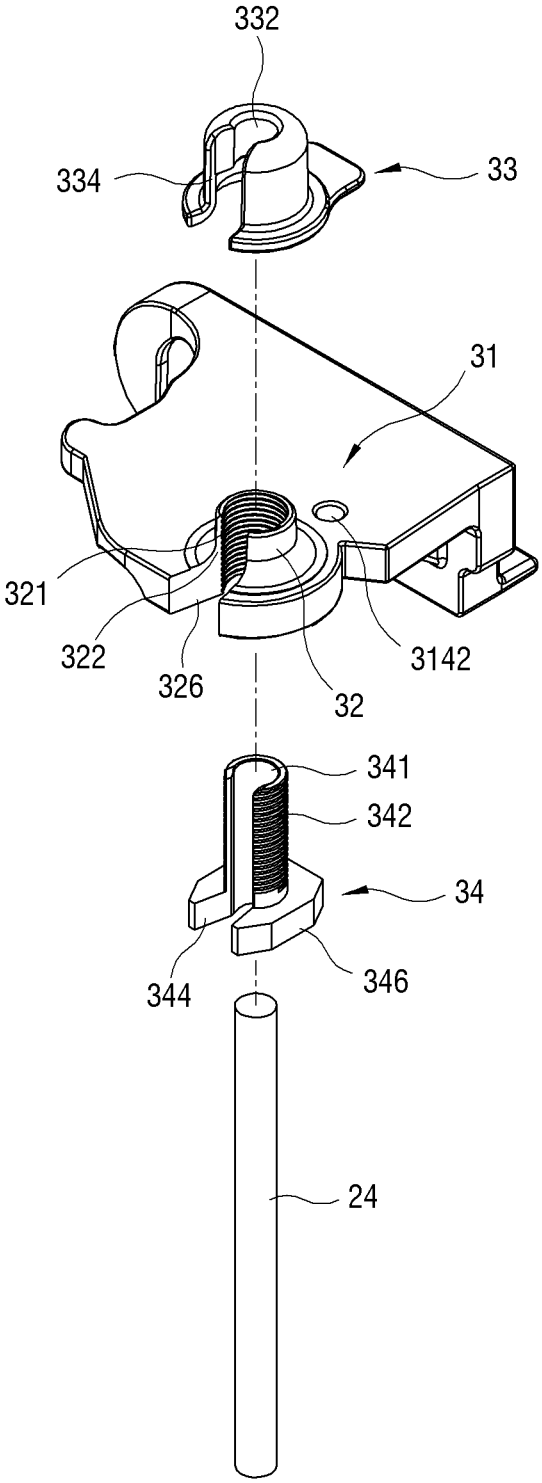
FIG. 4 is an exploded perspective view of the hinge in FIG. 3.
Figure 5:
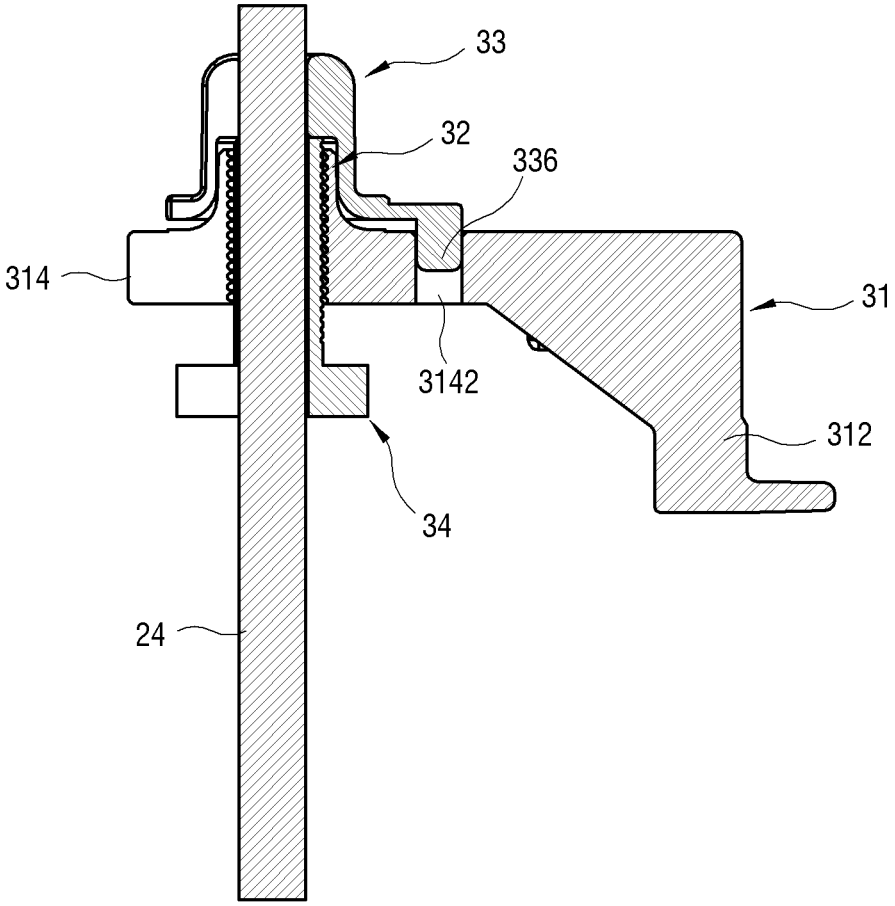
FIG. 5 is a cross-sectional view taken along line A-A in FIG. 3.
Figure 6:
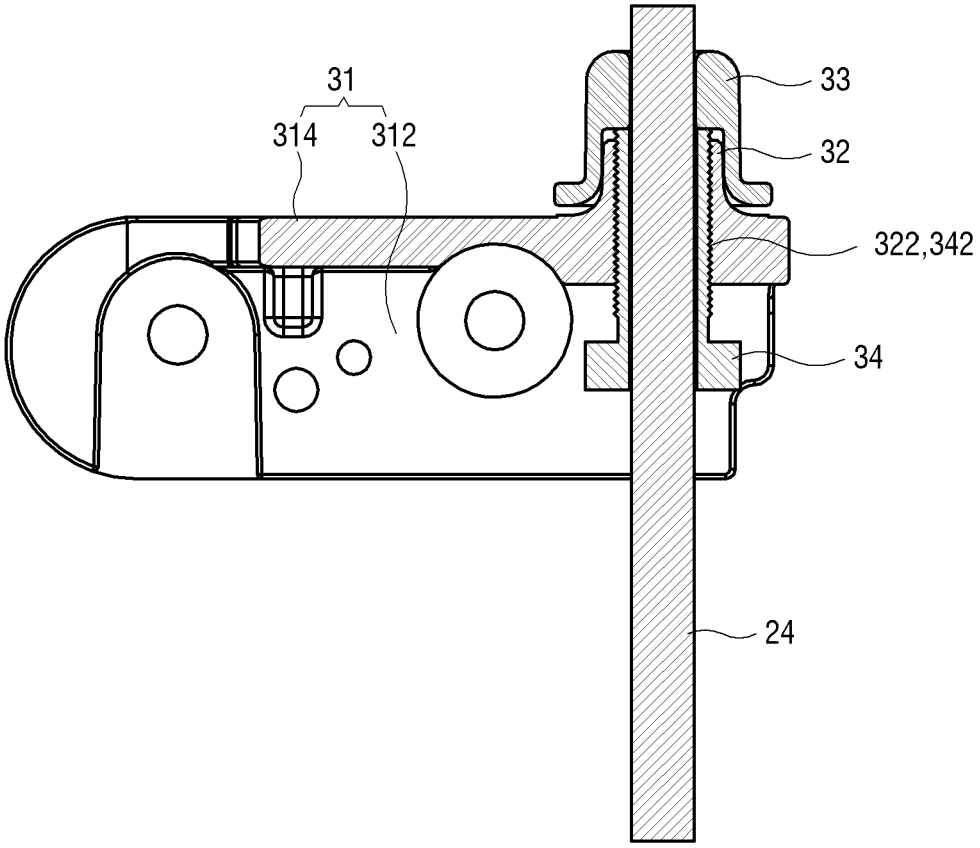
FIG. 6 is a cross-sectional view taken along line B-B in FIG. 3.

FIG. 2 is a front view showing that a hinge is applied to a door, FIG. 3 is a perspective view of a hinge in the refrigerator according to the first embodiment of the disclosure, FIG. 4 is an exploded perspective view of the hinge in FIG. 3, FIG. 5 is a cross-sectional view taken along line A-A in FIG. 3, and FIG. 6 is a cross-sectional view taken along line B-B in FIG. 3.

Referring to FIGS. 2 to 6, the hinge 30 may include a hinge frame 31 supported on the main body 10, a hinge pin 32 provided in the hinge frame 31, a hinge cap 33 covering the hinge pin 32, and a height-adjustment member 34 for adjusting the height of the hinge cap 33.

The hinge frame 31 may include a main-body coupling portion 312 shaped like a plate to couple with the main body 10, and a hinge-supporting portion 314 shaped like a plate bent from the main-body coupling portion 312 and extended in a direction parallel to the bottom surface of the door 20.

The main-body coupling portion 312 may include a plurality of screw fastening holes 3122 to couple with the main body 10.

The hinge-supporting portion 314 may be disposed in parallel with the bottom surface of the door 20. The hinge-supporting portion 314 may be provided with the hinge pin 32 at a position corresponding to a hinge hole 22 of the door 20 shown in FIG. 2. The hinge-supporting portion 314 may be formed with a projection accommodating hole 3142 positioned around the hinge pin 32 and preventing the hinge cap 33 from rotating.

The hinge pin 32 may be integrally extended upward from the top surface of the hinge-supporting portion 314 along a hinge axial direction. Of course, the hinge pin 32 and the hinge-supporting portion 314 may be individually manufactured and then coupled to each other or may be coupled by co-injection molding.

The hinge pin 32 may include a through portion 321 formed along the hinge axial direction, a first threaded portion 322 formed on an inner surface of the through portion 321, and a first cut-out portion 326 hollowed extending along the hinge axial direction so that the through portion 321 can communicate with the outside at one side. The details of the first cut-out portion 326 will be described later.

The hinge cap 33 may include a hinge-pin accommodating portion 332 accommodating the hinge pin 32, and a second cut-out portion 334 hollowed extending along the hinge axial direction so that the hinge-pin accommodating portion 332 can communicate with the outside at one side. The details of the second cut-out portion 334 will be described later.

The hinge cap 33 may move up and down in the hinge axial direction while covering the top of the hinge pin 32. The hinge cap 33 may be inserted in the hinge hole 22 of the door 20 shown in FIG. 2 as it is put on the hinge pin 32. In result, the door 20 can pivot on the hinge cap 33.

The hinge cap 33 may include a projection 336 to be inserted in the projection accommodating hole 3142 of the hinge-supporting portion 314 so as to prevent rotation.

The height-adjustment member 34 is shaped like a bolt, and may include a linear member accommodator 341 having a central-penetrating space along a lengthwise direction, a second threaded portion 342 formed on an outer surface of the linear member accommodator 341, a third cut-out portion 344 hollowed extending along the hinge axial direction so that the linear member accommodator 341 can communicate with the outside at one side, and a head 346.

The second threaded portion 342 of the height-adjustment member 34 may be fastened to the first threaded portion 322 formed on the inner surface of the through portion 321 of the hinge pin 32. The end of the second threaded portion 342 may be in contact with the inner top of the hinge-pin accommodating portion 332 of the hinge cap 33.

The linear member accommodator 341 may include a space formed by the third cut-out portion 344 instead of forming the central-penetrating space along the lengthwise direction.

The hinge cap 33 is provided to align the first cut-out portion 326 and the second cut-out portion 334 while the hinge cap 33 is put on the hinge pin 32. The third cut-out portion 344 may be aligned with the first cut-out portion 326 and the second cut-out portion 334, and at this time the outside and the space of the linear member accommodator 341 can communicate with each other. Therefore, it is possible to accommodate a linear member 24 drawn out from the door 20 in the space of the linear member accommodator 341 through the first cut-out portion 326, the second cut-out portion 334 and the third cut-out portion 344. In other words, the first to third cut-out portions 326 to 344 may be used as a passage via which the linear member 24 drawn out from the door 20, for example, an electric wire for supplying electric power or a communication line for transmitting a signal, can be easily put from the outside into the space of the linear member accommodator 341.

Then, when the height-adjustment member 34 is turned beyond a predetermined angle, the communicating space is closed, thereby preventing the linear member 24 accommodated in the space of the linear member accommodator 341 from coming off.

The head 346 may fit a tool, for example, a spanner, a wrench or the like tool to turn the height-adjustment member 34.

When the spanner or the like tool is used to turn the height-adjustment member 34, the hinge cap 33 supported at the end of the second threaded portion 342 moves up or down, thereby lifting the door 20 up or down.

Figure 7:
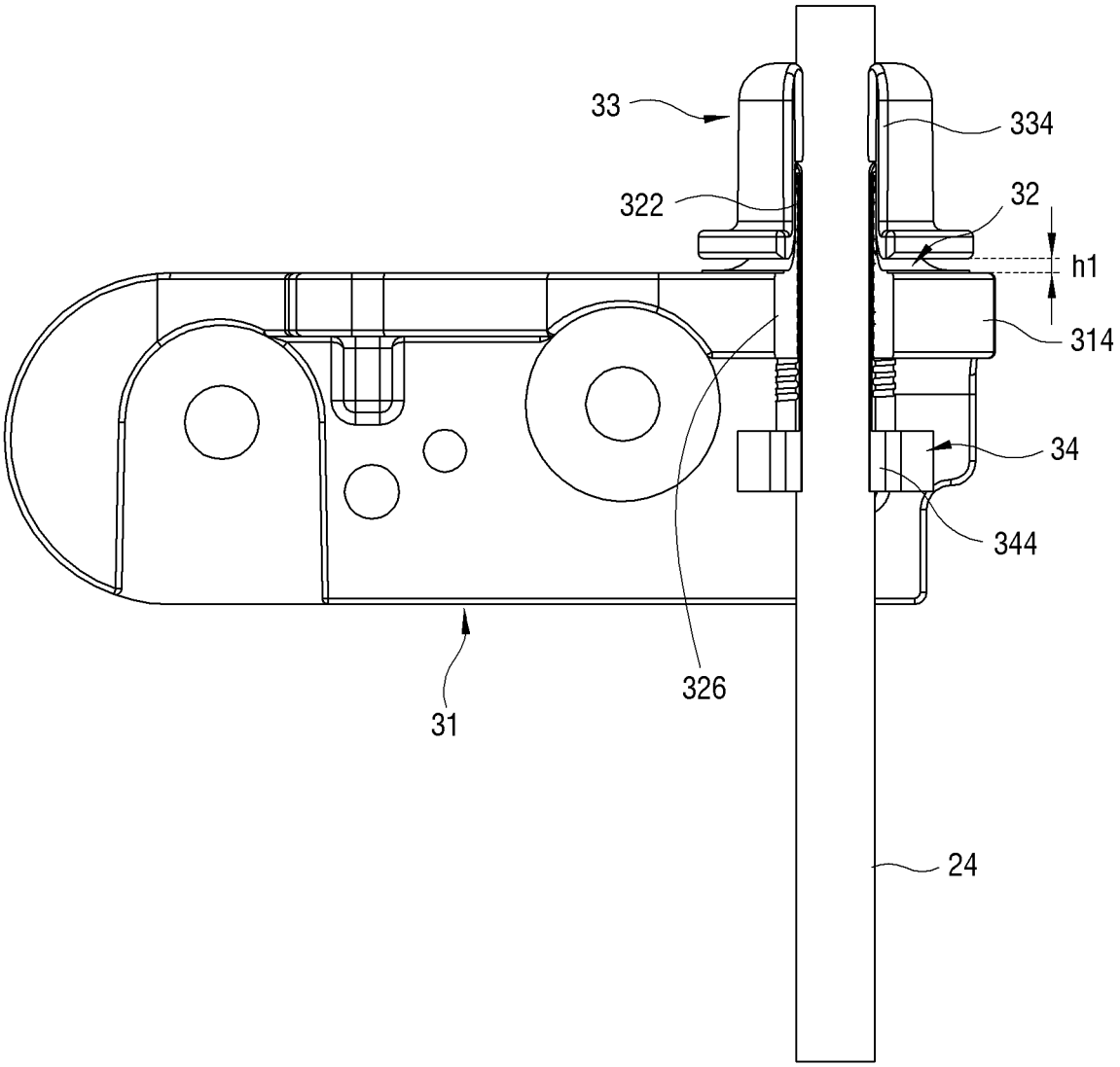
FIG. 7 illustrates a state before height difference adjustment of the hinge according to the first embodiment of the disclosure.
Figure 8:
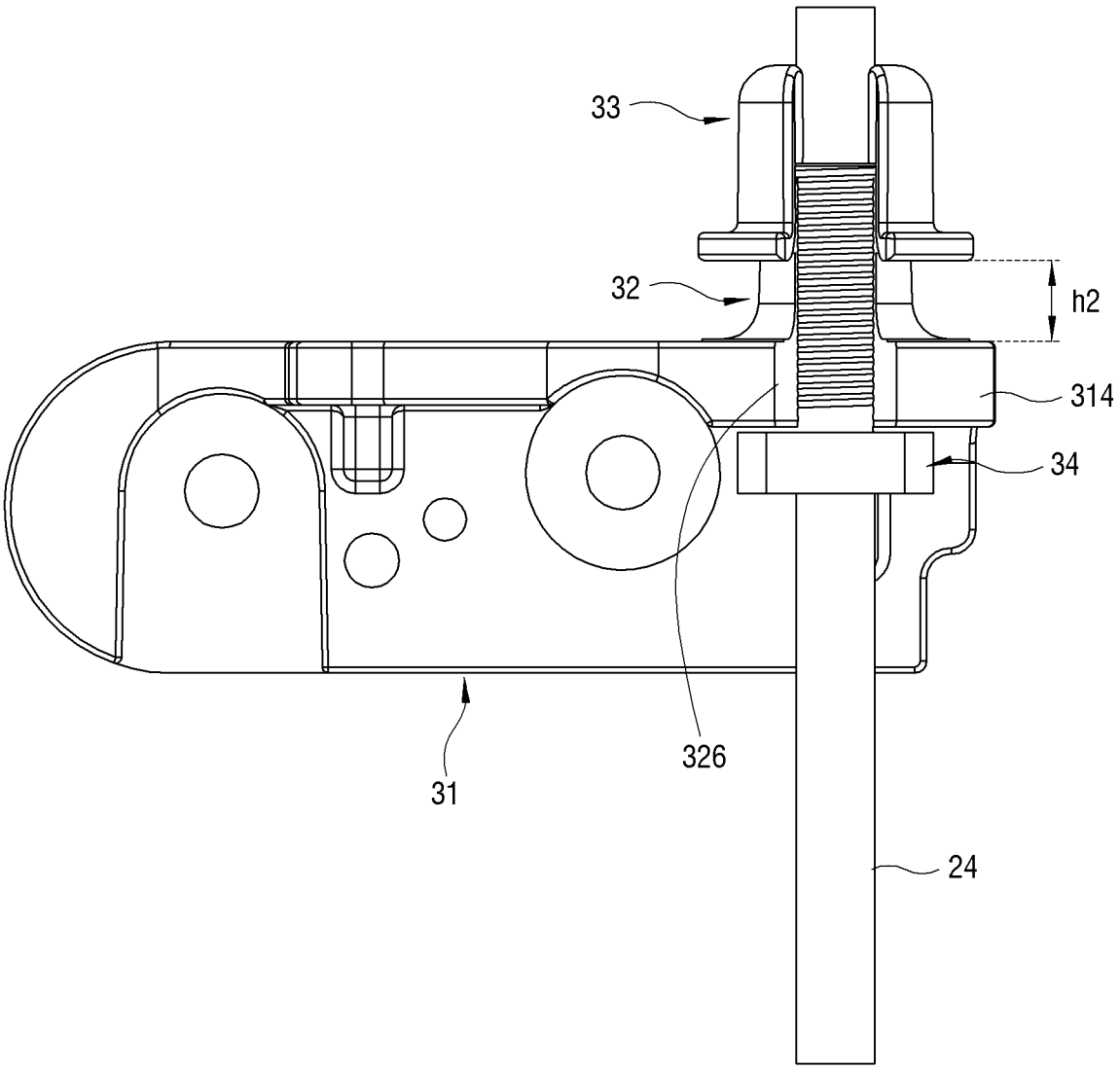
FIG. 8 illustrates a state after height difference adjustment of the hinge according to the first embodiment of the disclosure.

FIG. 7 illustrates a state before height difference adjustment of the hinge according to the first embodiment of the disclosure, and FIG. 8 illustrates a state after height difference adjustment of the hinge according to the first embodiment of the disclosure.

Referring to FIG. 7, when the door 20 is coupled to the main body 10 of the refrigerator 1, the linear member 24 of the door 20 is inserted through the first to third cut-out portions 326, 334 and 344. In this case, if the first to third cut-out portions 326, 334 and 344 are not aligned with one another, it is impossible to insert the linear member 24. Therefore, the height-adjustment member 34 is turned until the first to third cut-out portions 326, 334 and 344 are aligned with one another.

If a floor on which the refrigerator 1 will be installed is not flat, the door 20 coupled to the main body 10 by the hinge 30 may be distorted. In this case, there is a need of adjusting the height of the door 20 by adjusting the height of the hinge cap 33 fitted to the hinge hole 20 of the door 20 in the state that the bottom of the hinge cap 33 is at a height h1 from the top surface of the hinge-supporting portion 314 of the hinge frame 31 as shown in FIG. 7.

Referring to FIG. 8, when the height-adjustment member 34 is turned in a screw forward direction, the end of the second threaded portion 342 can push up the hinge cap 33. In this case, the bottom of the hinge cap 33 is moved up to a height h2 from the top surface of the hinge-supporting portion 314 of the hinge frame 31. In result, the door 20 is lifted up as the hinge cap 33 moves up. Further, when the height-adjustment member 34 is turned as above, the third cut-out portion 344 becomes misaligned with the first and second cut-out portions 326 and 334, thereby closing the space of the linear member accommodator 341 and thus preventing the linear member 24 accommodated in the space of the linear member accommodator 341 from coming off.

On the other hand, the height-adjustment member 34 is turned in a screw backward direction to lift down the door 20.

Figure 9:
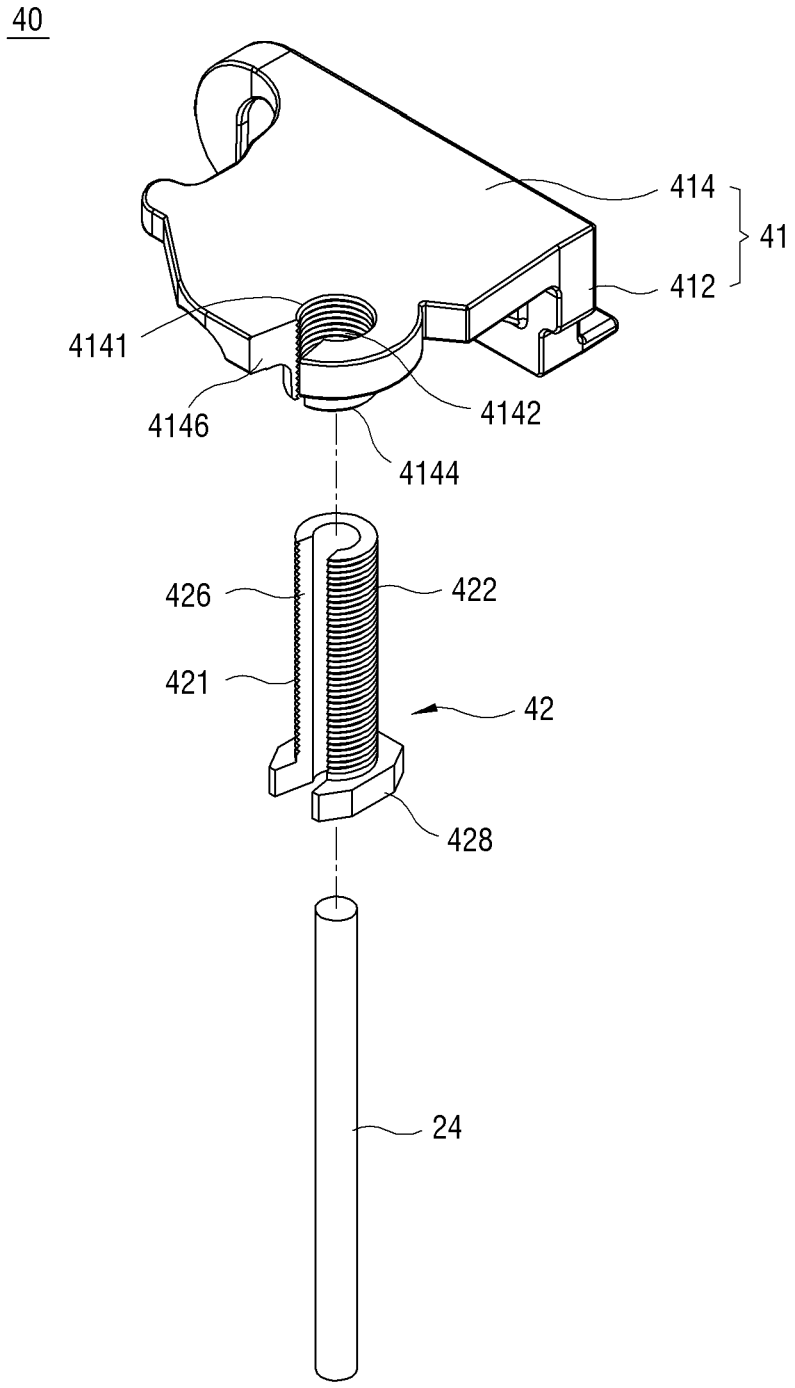
FIG. 9 is an exploded perspective view of a hinge according to a second embodiment of the disclosure.
Figure 10:
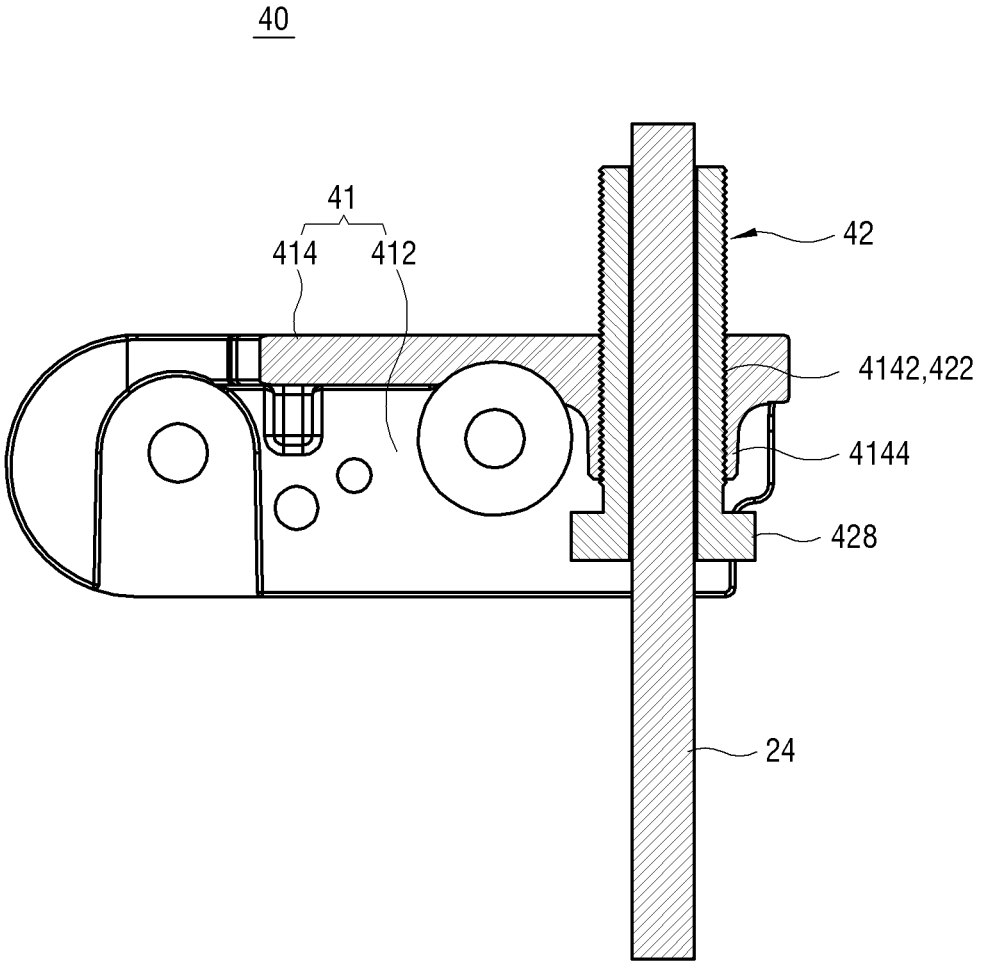
FIG. 10 illustrates an assembled cross-section of the hinge of FIG. 9.

FIG. 9 is an exploded perspective view of a hinge 40 according to a second embodiment of the disclosure, and FIG. 10 illustrates an assembled cross-section of the hinge 40 of FIG. 9.

Referring to FIGS. 9 and 10, the hinge 40 may include a hinge frame 41 and a hinge pin 42 (which can also be referred to as a height-adjustment member).

The hinge frame 41 may include a main-body coupling portion 412 shaped like a plate to couple with the main body 10, and a hinge-supporting portion 414 shaped like a plate bent from the main-body coupling portion 412 and extended in a direction parallel to the bottom surface of the door 20.

The hinge-supporting portion 414 may be extended in parallel with the bottom surface of the door 20. The hinge-supporting portion 414 may include a hinge-pin coupling hole 4141 to which a hinge pin 42 is coupled at a position corresponding to the hinge hole 22 of the door 20 shown in FIG. 2, a protruding portion 4144 protruding downward to make the hinge-pin coupling hole 4141 deeper, and a fourth cut-out portion 4146 hollowed extending along the hinge axial direction so that the hinge-pin coupling hole 4141 can communicate with the outside at one side.

The hinge-pin coupling hole 4141 is formed with a third threaded portion 4142 on an inner surface thereof.

The protruding portion 4144 may protrude and extend downward to make the third threaded portion 4142 longer so that the hinge pin 42 can be firmly fastened thereto.

The fourth cut-out portions 4146 may be used as a passage via which the linear member 24 drawn out from the door 20, for example, an electric wire for supplying electric power or a communication line for transmitting a signal can be easily put from the outside into a space of a linear member accommodator 421 (to be described later).

The hinge pin 42 is shaped like a bolt, and may include the linear member accommodator 421 penetrated in a lengthwise direction, a fourth threaded portion 422 formed on an outer surface of the linear member accommodator 421, a fifth cut-out portion 426 hollowed extending along the hinge axial direction so that the linear member accommodator 421 can communicate with the outside at one side, and a head 428 provided at one end of the fourth threaded portion 422.

The fourth threaded portion 422 may be fastened to the third threaded portion 4142 of the hinge-supporting portion 414. Therefore, the hinge pin 42 is screw-coupled to the hinge frame 41.

The linear member 24 inserted via the fifth cut-out portion 426 is accommodated in the space in the linear member accommodator 421.

Like the first embodiment, the fifth cut-out portion 426 may be used as a passage via which the linear member 24 drawn out from the door 20 is inserted into the space of the linear member accommodator 421.

The head 428 may be picked up and turned by the spanner or the like tool.

As described above, the hinge 40 according to the second embodiment can directly lift up or down the door 20 by the hinge pin 42.

Figure 11:
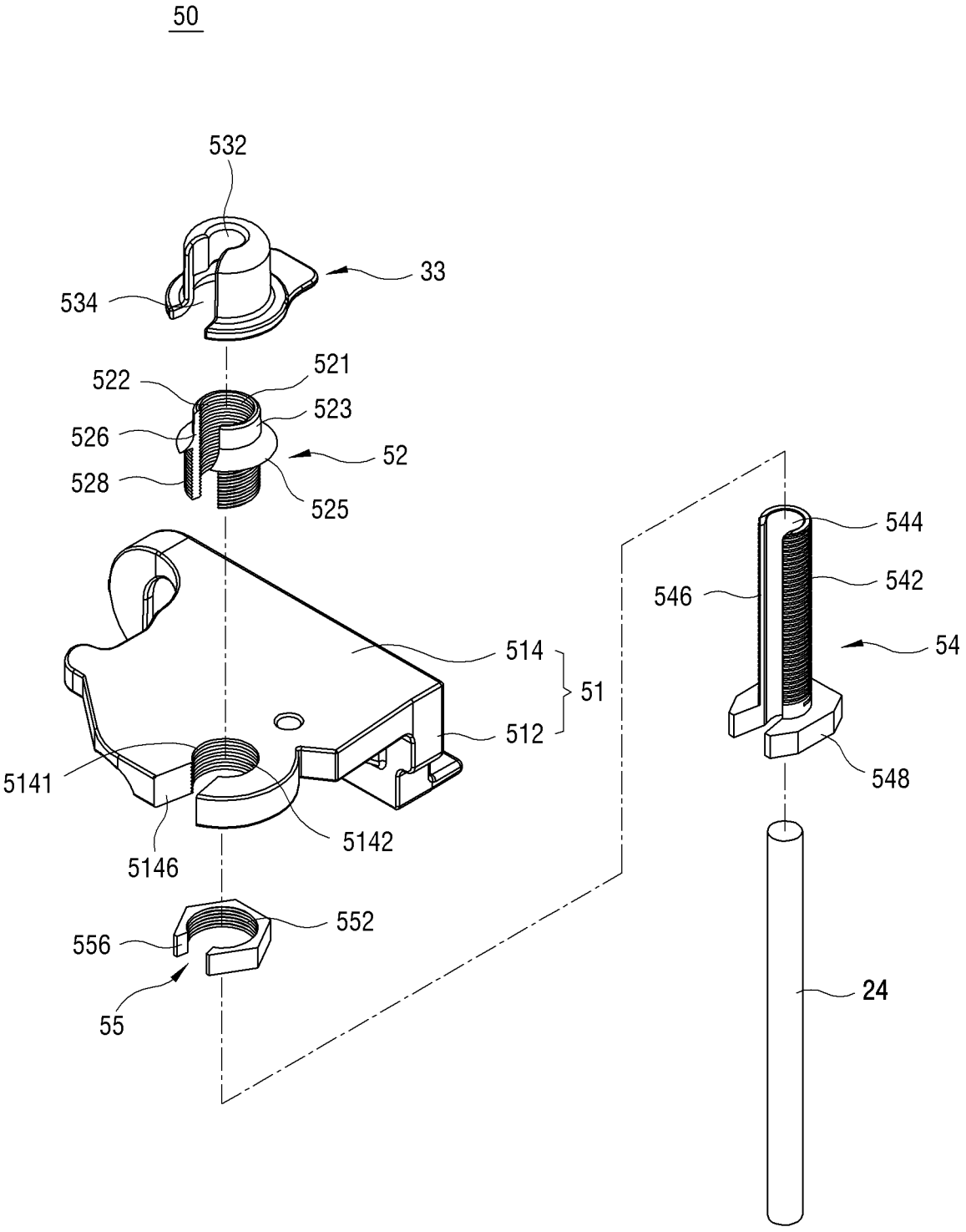
FIG. 11 is an exploded perspective view of a hinge according to a third embodiment of the disclosure.
Figure 12:
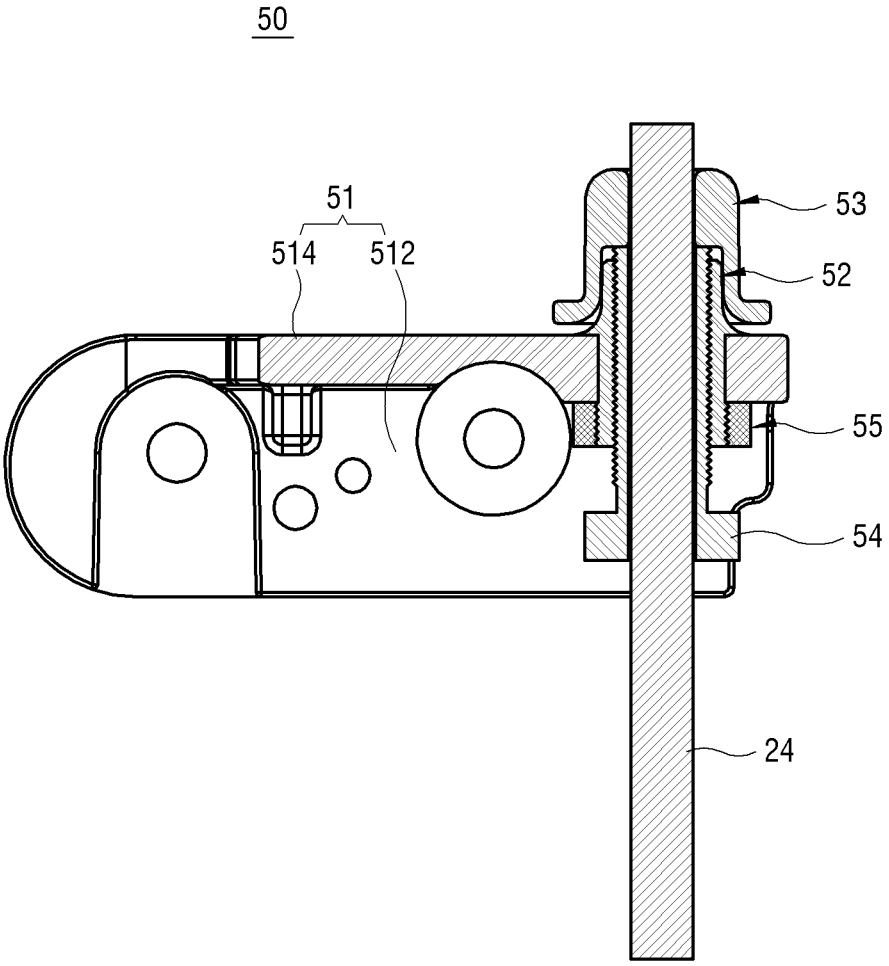
FIG. 12 illustrates an assembled cross-section of the hinge of FIG. 11.

FIG. 11 is an exploded perspective view of a hinge 50 according to a third embodiment of the disclosure, and FIG. 12 illustrates an assembled cross-section of the hinge 50 of FIG. 11.

Referring to FIGS. 11 and 12, a hinge 50 may include a hinge frame 51 supported on the main body 10, a hinge pin 52 provided in the hinge frame 51, a hinge cap 53 covering the hinge pin 52, a height-adjustment member 54 for adjusting the height of the hinge cap 53, and a nut 55. The hinge cap 53 and the height-adjustment member 54 are similar to the hinge cap 33 and the height-adjustment member 34 of the hinge according to the first embodiment, and therefore repetitive descriptions thereof will be avoided.

The hinge frame 51 may include a main-body coupling portion 512 shaped like a plate fastened to the main body 10, and a hinge-supporting portion 514 shaped like a plate bent from the main-body coupling portion 512 and extended in a direction parallel to the bottom surface of the door 20.

The hinge-supporting portion 514 may include a hinge-pin coupling hole 5141 to which the hinge pin 52 is fastened at a position corresponding to the hinge hole 22 of the door 20 shown in FIG. 2, and a sixth cut-out portion 5146 hollowed extending along the hinge axial direction so that the hinge-pin coupling hole 5141 can communicate with the outside at one side.

The hinge-pin coupling hole 5141 is formed with a fifth threaded portion 5142 on an inner surface thereof.

The hinge pin 52 may for example be made of metal or the like solid material.

The hinge pin 52 may include a through portion 521 penetrated in the hinge axial direction, a sixth threaded portion 522 provided on the inner surface of the through portion 521, a hinge shaft portion 523 protruding upward in the hinge axial direction, a flange portion 525 extended in a radial direction of the hinge shaft portion 523, a seventh cut-out portion 526 hollowed extending along the axial direction so that the through portion 521 can communicate with the outside at one side, and a seventh threaded portion 528 protruding from the flange portion 525 downward in the hinge axial direction The hinge pin 52 may be coupled to the hinge-supporting portion 514 as the seventh threaded portion 518 of the hinge pin 52 is fastened to the fifth threaded portion 5142 of the hinge-pin coupling hole 5141.

The nut 55 may include an eighth threaded portion 552 to be fastened to the seventh threaded portion 528 of the hinge pin 52 protruding from the bottom of the hinge-supporting portion 514, and an eighth cut-out portion 556 hollowed extending along the hinge axial direction at one side.

As described above, for example, when the hinge pin 52 made of metal is coupled to the hinge-supporting portion 514 made of plastic, the sixth threaded portion 522 formed on the inner surface of the through portion 521 of the metal hinge pin 52 has durability high enough to bear the heavy load of the door 20 when screw-coupling with the height-adjustment member 34, and defective screw-coupling caused by the formation of the cut-out portion.

As described above, the refrigerator according to the disclosure is convenient to adjust the height difference of the door by the hinge that is movable up and down.

Further, the refrigerator according to the disclosure is improved in an outer appearance because the cut-out portion cut in the hinge axial direction is formed in the hinge coupled to the door, and the electric wire and the like members drawn out from the door are inserted through the cut-out portion.

Although a few embodiments of the disclosure have been described in detail, various changes can be made in the disclosure without departing from the scope of claims.

What is claimed is:

1. A refrigerator comprising:

a main body including a storage space;

a door to open and close the storage space; and a hinge, provided under the door, to rotatably couple the door to the main body, the hinge comprising:

a height-adjustment member that is movable up and down to adjust a height of the door with respect to a surface on which the refrigerator is installed, wherein the height-adjustment member has a body forming a space that extends inside the body along an axial direction of the hinge from an opening in a bottom end of the body to an opening in a top end of the body, in which to accommodate a linear member, which is an electric wire or communication line, so that the linear member passes through the opening in the bottom end of the body, through the space, and through the opening in the top end of the body, and the body has a cut-out portion extending along the axial direction to allow the linear member to pass through the cut-out portion to be accommodated in the space formed by the body.

2. The refrigerator according to claim 1, wherein
the hinge comprises:
a hinge pin, and
a hinge cap configured to cover the hinge pin, and
the height-adjustment member cooperates with the hinge pin to move up and down, to thereby adjust a height of the hinge cap, and thereby adjust the height of the door with respect to the surface.

3. The refrigerator according to claim 2, wherein
the hinge pin has a body forming a space that extends inside the body of the hinge pin along the axial direction from an opening in a bottom end of the body of the hinge pin to an opening in a top end of the body of the hinge pin, in which to accommodate the linear member so that the linear member passes through the opening in the bottom end of the body of the hinge pin, through the space formed by the body of the hinge pin, and through the opening in the top end of the body of the hinge pin,
the body of the hinge pin has a cut-out portion extending along the axial direction to allow the linear member to pass through the cut-out portion of the body of the hinge pin to be accommodated in the space formed by the body of the hinge pin, and
the hinge cap has a body forming a space that extends inside the body of the hinge cap along the axial direction from an opening in a bottom end of the body of the hinge cap to an opening in a top end of the body of the hinge cap, in which to accommodate the linear member so that the linear member passes through the opening in the bottom end of the body of the hinge cap, through the space formed by the body of the hinge cap, and through the opening in the top end of the body of the hinge cap, and
the body of the hinge cap has a cut-out portion extending along the axial direction to allow the linear member to pass through the cut-out portion of the body of the hinge cap to be accommodated in the space formed by the body of the hinge cap.

4. The refrigerator according to claim 1, wherein
the height-adjustment member is a hinge pin.

5. The refrigerator according to claim 2, wherein
an inner surface of the body of the hinge pin has a first threaded portion formed thereon, and
the height-adjustment member has a second threaded portion that cooperates with the first threaded portion to move the height adjustment member up and down.

6. The refrigerator according to claim 1, wherein
the hinge comprises:
a hinge frame supported on the main body, and
a hinge pin integrally formed in the hinge frame, and
the height-adjustment member cooperates with the hinge pin to move up and down.

7. The refrigerator according to claim 1, wherein
the hinge comprises:
a hinge frame comprising a hinge-pin coupling hole penetrated in the axial direction, and
a hinge pin fastened to the hinge-pin coupling hole, and
the height-adjustment member cooperates with the hinge pin to move up and down.

8. The refrigerator according to claim 7, wherein
the hinge pin has a body forming a space that extends inside the body of the hinge pin along the axial direction from an opening in a bottom end of the body of the hinge pin to an opening in a top end of the body of the hinge pin, in which to accommodate the linear member so that the linear member passes through the opening in the bottom end of the body of the hinge pin, through the space formed by the body of the hinge pin, and through the opening in the top end of the body of the hinge pin,
the body of the hinge pin has a cut-out portion extending along the axial direction to allow the linear member to pass through the cut-out portion of the body of the hinge pin to be accommodated in the space formed by the body of the hinge pin,
the hinge frame has a body forming a space that extends inside the body of the hinge frame along the axial direction from an opening in a bottom end of the body of the hinge frame to an opening in a top end of the body of the hinge frame, in which to accommodate the linear member so that the linear member passes through the opening in the bottom end of the body of the hinge frame, through the space formed by the body of the hinge frame, and through the opening in the top end of the body of the hinge frame, and
the body of the hinge frame has a cut-out portion extending along the axial direction to allow the linear member to pass through the cut-out portion of the body of the hinge frame to be accommodated in the space formed by the body of the hinge frame.

9. The refrigerator according to claim 1, wherein
the hinge comprises:
a hinge frame supported on the main body,
a nut supported on the hinge frame, and
a hinge pin screw-coupled to the nut, and
the height-adjustment member cooperates with the hinge pin to move up and down.

10. The refrigerator according to claim 9, wherein
the hinge pin has a body forming a space that extends inside the body of the hinge pin along the axial direction from an opening in a bottom end of the body of the hinge pin to an opening in a top end of the body of the hinge pin, in which to accommodate the linear member so that the linear member passes through the opening in the bottom end of the body of the hinge pin, through the space formed by the body of the hinge pin, and through the opening in the top of the body of the hinge pin,
the body of the hinge pin has a cut-out portion extending along the axial direction to allow the linear member to pass through the cut-out portion of the body of the hinge pin to be accommodated in the space formed by the body of the hinge pin,
the nut has a body forming a space that extends inside the body of the nut along the axial direction from an opening in a bottom end of the body of the nut to an opening in a top end of the body of the nut, in which to accommodate the linear member so that the linear member passes through the opening in the bottom end of the body of the nut, through the space formed by the body of the nut, and through the opening in the top of the body of the nut, and
the body of the nut has a cut-out portion extending along the axial direction to allow the linear member to pass through the cut-out portion of the body of the nut to be accommodated in the space formed by the body of the nut.

11. The refrigerator according to claim 3, wherein
the hinge is configured so that the linear member is receivable into, and thereby accommodated into, the space formed by the body of the height-adjustment member, the space formed by the body of the hinge pin, and the space formed by the body of the hinge cap, when the cut-out portion of the body of the height-adjustment member, the cut-out portion of the body of the hinge pin, and the cut-out portion of the body of the hinge cap are aligned, and when the linear member is accommodated in the space formed by the body of the height-adjustment member, the space formed by the body of the hinge pin, and the space formed by the body of the hinge cap, and the cut-out portion of the body of the height-adjustment member, the cut-out portion of the body of the hinge pin, and the cut-out portion of the body of the hinge cap are no longer aligned due to turning the height-adjustment member, the linear member is prevented from coming out of the space formed by the body of the height-adjustment member.

* * * * *